United States Patent [19]

Griffin

[11] 4,010,504

[45] Mar. 8, 1977

[54] GATE HINGE

[76] Inventor: Ronald G. Griffin, 1616 W. 13th, Houston, Tex. 77008

[22] Filed: July 3, 1975

[21] Appl. No.: 582,995

[52] U.S. Cl. ..... 16/158

[51] Int. Cl.[2] ..... E05D 5/02

[58] Field of Search ..... 16/158, 174, 129, 147, 16/130, 131, 132, 133, 153, 158, 86.1, 86.2, 159, 187, 128 R; 287/14

[56] References Cited

UNITED STATES PATENTS

| | | | |
|---|---|---|---|
| 1,168,523 | 1/1916 | Louden | 16/158 |
| 2,122,831 | 7/1938 | Atwood et al. | 16/131 X |
| 3,751,084 | 8/1973 | Lening | 16/158 X |
| 3,751,759 | 8/1973 | Duncan | 16/153 X |
| 3,811,149 | 5/1974 | Griffin | 16/130 |

*Primary Examiner*—G. V. Larkin
*Attorney, Agent, or Firm*—Ranseler O. Wyatt

[57] ABSTRACT

A gate hinge for fences, particularly steel mesh fences, having means for mounting the gate post members and the fence post members in alignment with each other and which may be readily adjusted laterally without disconnecting the respective hinge members.

4 Claims, 2 Drawing Figures

GATE HINGE

BACKGROUND OF THE INVENTION

In mounting gates on steel fences, particularly industrial fences, where the gates are long and heavy, it is necessary to adjust the hinge members so that the gate will fully open with a 180° swing. With the hinges presently in use, their construction prevents opening of the gate, in one direction, to much more than 90°, and where a long heavy gate is employed, it is very difficult to maintain the gate properly hung in horizontal alignment. It is an object of this invention to provide a gate hinge consisting of a male and female member that can be quickly and easily installed, adjusted and maintained in alignment.

DESCRIPTION OF THE PREFERRED EMBODIMENT

Figure 1:
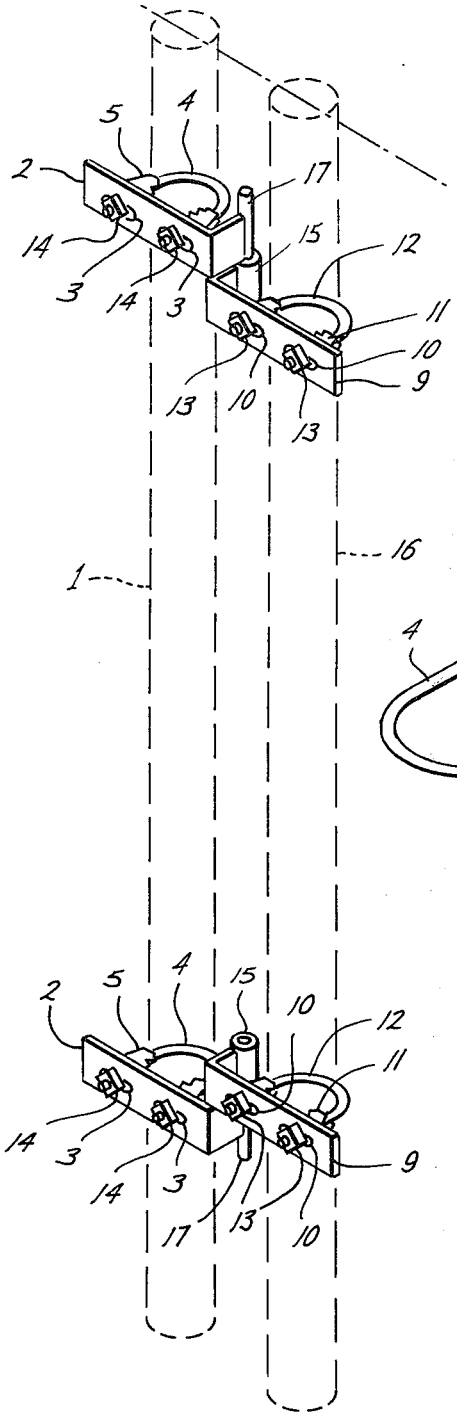
FIG. 1 is a side elevational view of the hinges, showing the respective posts in dotted lines.
Figure 2:
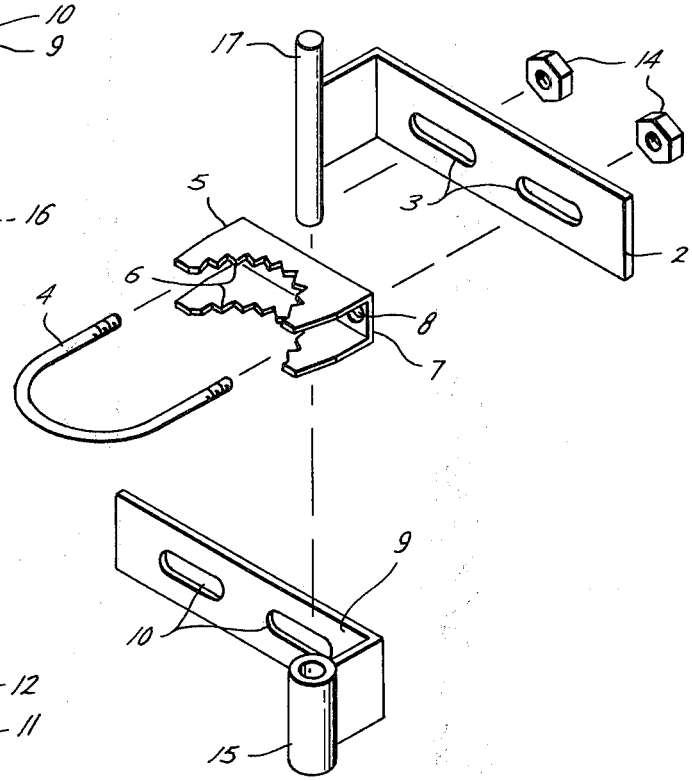
FIG. 2 is an exploded view of the parts of the respective hinges.

In the drawing, the numeral 1 designates a fence post, such as the tubular steel member employed in construction of steel fences, on which a male member 2 is mounted adjacent the top of the post, and another adjacent the bottom of the post, the male member 2 having elongated slots 3, 3 which receive the externally threaded ends of the U-bolt 4, and which are adapted to receive the nuts 14, 14, and a post gripping member 5 has a pair of integral arcuate jaws 6, 6 and a flat base 7 and bolts holes as 8 to receive the respective ends of the U-bolt 4.

The male member 2 is bent at a right angle adjacent one end, and a post 17, extending vertically beyond the side of the body of the male member is integral with the end face of said bent end.

The female member 9 has the slots 10, 10 and a post gripping member 11, constructed as above described for the member 5, through which the U-bolt 12 extends, the ends of the U-bolt 12 having external threads to receive the nuts 13, 13, the parts 12, 11 and 9 functioning in the same way as the parts 4, 5 and 2. The member 9 is bent at a right angle adjacent one end and has the tubular member 15 mounted on said end. When mounted on the gate post and the hinge post, before final tightening of the nuts 13, 14, the members are rotated on the respective posts until the pin 17 and socket 15 are in axial alignment, and in alignment with the center line of the respective posts, when the nuts 13, 14 are tightened to anchor the members to the posts.

In hanging a gate, the male members 2, 2 are mounted on the fence post bordering the gate opening, and with the post 17 aligned with the center of the post 1, and the fence (not shown). The gripping member 5 is mounted on the U-bolt 4, with the arcuate jaws 6, 6 bearing against the post 1, and the threaded ends of the U-bolt extending through the elongated slots 3, 3, and the nuts 14, 14 mounted on said threaded ends and when the member 2 is laterally adjusted, the nuts are tightened to maintain the member 2 in position. The female member 9 is similarly mounted on the gate post 16 with the socket of the uppermost member receiving the lower end of the post 17 on the uppermost hinge member 2 and the socket of the lowermost member 9 receiving the upper end of the post 17 on the lowermost male hinge member. As may be seen, any lateral adjustment necessary to the gate may be readily made by loosening the nuts of either member, and sliding the member laterally within the slots 3 or 10.

If desired, the respective male and female members may be constructed without the right angle bend, where an opening in one direction only is desired.

This application is an improvement over the invention made the subject matter of a previous application for patent which has matured into U.S. Pat. No. 3,811,149.

What I claim is:

1. A gate hinge having a male and female member, elongated slots in said members, U-bolts having their respective ends externally threaded and adapted to extend through said slots, post gripping means mounted on said U-bolts and abutting said hinge members, and means on said male and female members for pivotally engaging said male and female members.

2. The device defined in claim 1 wherein said post gripping means consist of a pair of toothed arcuate jaws.

3. The device defined in claim 1 wherein said hinge members each are bent at a right angle adjacent one end, said means for pivotally engaging said male and female members consisting of a post mounted on the end adjacent said bend forming the male member, said post extending vertically beyond the respective margins of said male member, and said female member formed with a socket mounted on said end adjacent said bend adapted to receive one end of said post.

4. A gate hinge for use in mounting a gate on a gate post, a male and a female member, each member having a flat, elongated, rectangular body, with elongated slots extending therethrough, post gripping means mounted on said members, and longitudinally adjustable thereon and each of said members having a right angle bend adjacent one end, a socket formed in the end of the female member adjacent said bend and a vertical post on the end adjacent the bend in the male member, said post adapted to fit into said socket.

* * * * *